US010273047B2

(12) United States Patent
Dennis et al.

(10) Patent No.: US 10,273,047 B2
(45) Date of Patent: Apr. 30, 2019

(54) BEVERAGE CONTAINER

(71) Applicants: Autrige Dennis, Greenacres, FL (US); Oniel J Castro, Boynton Beach, FL (US)

(72) Inventors: Autrige Dennis, Greenacres, FL (US); Oniel J Castro, Boynton Beach, FL (US)

( * ) Notice: Subject to any disclaimer, the term of this patent is extended or adjusted under 35 U.S.C. 154(b) by 4 days.

(21) Appl. No.: 15/696,069

(22) Filed: Sep. 5, 2017

(65) Prior Publication Data

US 2019/0071215 A1 Mar. 7, 2019

(51) Int. Cl.
*B65D 23/02* (2006.01)
*B65D 8/00* (2006.01)

(52) U.S. Cl.
CPC ..... *B65D 23/02* (2013.01); *B65D 11/04* (2013.01)

(58) Field of Classification Search
CPC ..... B65D 23/02; B65D 11/04; B65D 81/365; B65D 81/366; B65D 2251/06; A45D 2034/007
USPC ..... 222/105, 131, 183, 78
See application file for complete search history.

(56) References Cited

U.S. PATENT DOCUMENTS 5,638,982 A * 6/1997 Spector ..... A63B 39/00 206/457
6,041,918 A * 3/2000 Moore ..... B65D 7/04 206/0.815
6,561,386 B1 * 5/2003 Martens ..... B65D 77/067 222/105
7,051,892 B1 * 5/2006 O'Day, Jr. ..... B65D 1/0223 215/10
8,651,308 B1 * 2/2014 Sung ..... A45D 40/00 206/457
2002/0159820 A1 * 10/2002 Louis ..... A45D 34/045 401/129
2013/0134161 A1 * 5/2013 Fogel ..... B65D 21/0209 220/23.83

* cited by examiner

*Primary Examiner* — Donnell A Long
(74) *Attorney, Agent, or Firm* — Grant Attorneys at Law PLLC; Kristin A. Grant

(57) ABSTRACT

A beverage container comprising of an inner casing for holding a beverage, the inner casing comprising of a spout for accessing the beverage, the spout comprising of a neck and a cap, an outer casing surrounding the inner casing, the outer casing comprising at least one placement surface for allowing the beverage container to sit stably on a flat surface, the at least one placement surface comprising of a rigid ring surrounding a flexible material wherein the flexible material can be manipulated using pressure into a concave shape thereby creating a horizontal plane for allowing the beverage container to sit stably on a flat surface, and an opening in the outer casing for accessing the spout of the inner casing.

13 Claims, 11 Drawing Sheets

BEVERAGE CONTAINER

BACKGROUND OF THE INVENTION

Field of the Invention

The present invention relates generally to beverage containers, and more specifically to a versatile beverage container customizable to take the shape of a specific item or character.

Related Art

For many years people have been purchasing merchandise with adornments based on their interests. By way of example only, sports fans have long acquired team memorabilia and merchandise to showcase when attending games/matches and otherwise. Kids desire goods such as lunchboxes, drink bottles, backpacks and other items which are adorned with themes and characters from their favorite shows. Theme parks offer attendees themed beverage containers and other themed items, which may be used while exploring the parks and similar venues.

The present invention is directed to a versatile beverage container. The beverage container being capable of serving multiple individuals simultaneously and of taking the shape of a specific item or character. Themed beverage containers are well known in the art, for example U.S. Pat. No. D415,929 discloses a basketball shaped beverage container; U.S. Pat. No. D420,255 discloses a soccer ball shaped beverage container; U.S. Pat. No. D478,417S1 discloses a sport beverage tote; U.S. Pat. No. D691,859S1 discloses a glove shaped beverage insulator; U.S. Pat. No. 5,50,815A discloses a drink container with an inner shell and an outer shell with decorative floatable and sinkable objects immersed in a liquid between the two shells; and U.S. Pat. No. 5,339,982A discloses a canteen for children comprising of decorative elements which may take the form of characters, fanciful vehicles or other objects involved in well-known children's stories or fairy tales. However, the present invention differs in structure and functionality from these known beverage containers. Additionally, these beverage containers are all single serve. People wishing to serve more than one individual would need to purchase two containers or use more than one straw in a single container. Embodiments of the present invention provide a single container which may be divisible to serve multiple users simultaneously.

SUMMARY OF THE INVENTION

It is to be understood that the phraseology and terminology employed herein are for the purpose of the description and should not be regarded as limiting.

The present invention is directed to a beverage container comprising of a an inner casing for holding a beverage, the inner casing comprising of a spout for accessing the beverage, the spout comprising of a neck and a cap, an outer casing surrounding the inner casing and an opening in the outer casing for accessing the spout of the inner casing. An embodiment of the beverage container being divisible into at least two segments, wherein each segment is removably attached by a connector, the connector comprising of two or more corresponding parts. These and other features of the present invention will become readily apparent upon further review of the specification and drawings.

BRIEF DESCRIPTION OF THE DRAWINGS

Embodiments of the present invention will be described by way of example only, and not limitation, with reference to the accompanying drawings in which.

DETAILED DESCRIPTION

Figure 1:
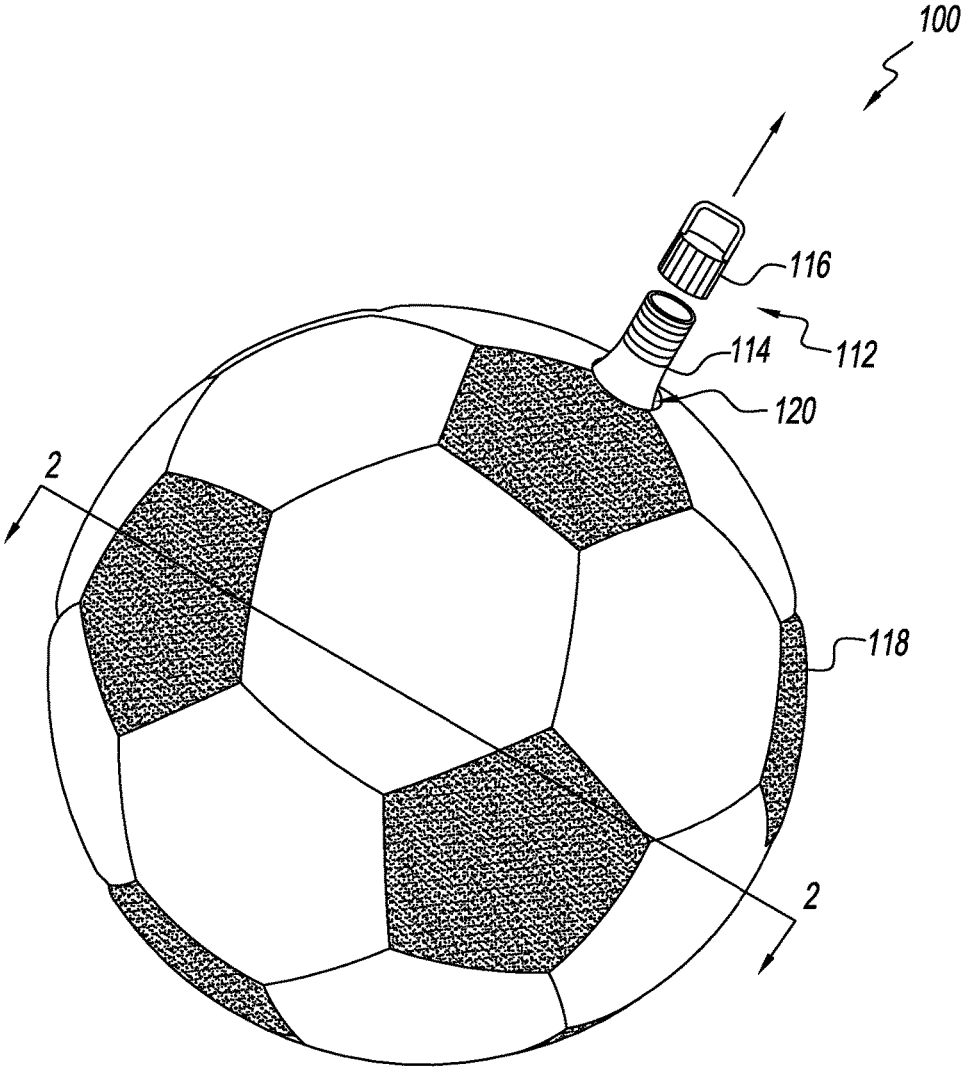
FIG. 1. is a perspective view of a beverage container according to an embodiment of the present invention.
Figure 2:
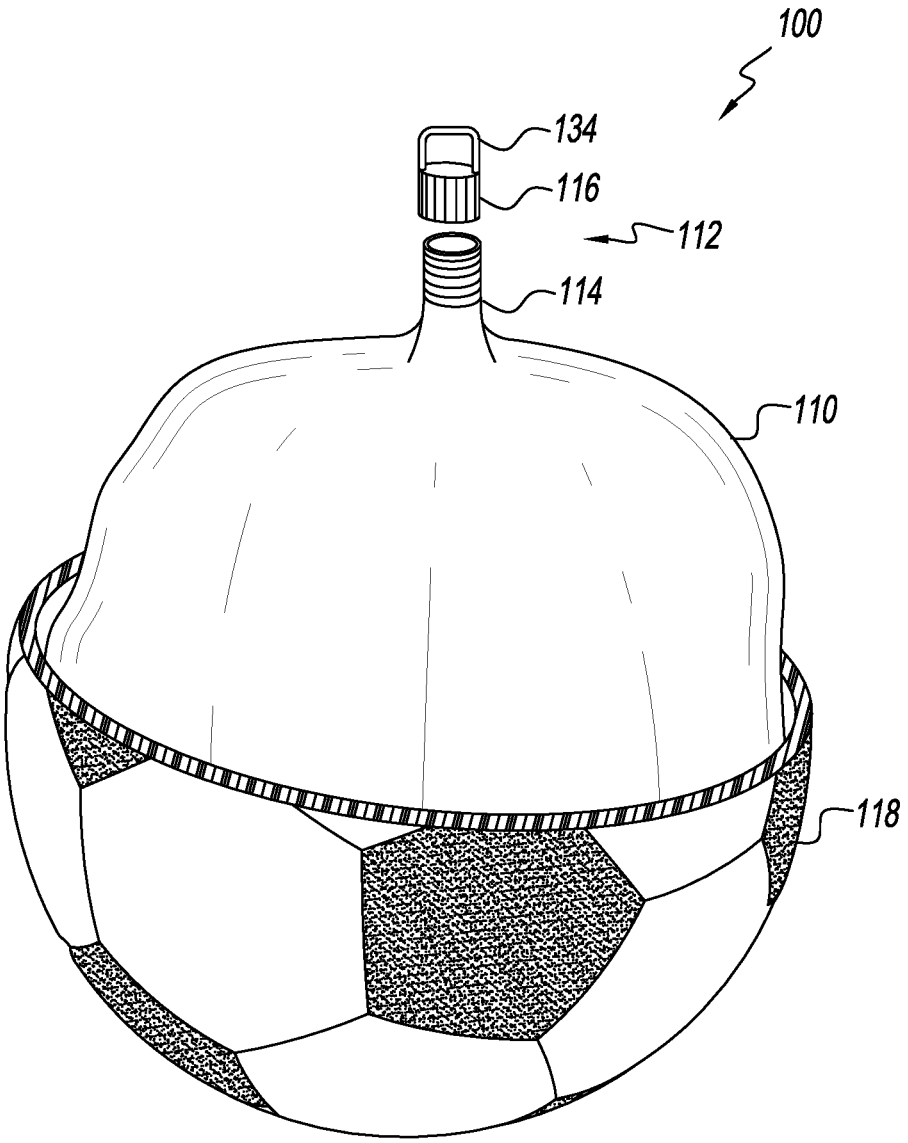
FIG. 2 is a perspective cutaway view of a beverage container according to one embodiment of the present invention.

Referring now to the figures, where similar reference characters denote similar elements throughout the figures, FIG. 1 and FIG. 2 show perspective views of a beverage container comprising of an inner casing 110 for holding a beverage, the inner casing 110 comprising of a spout 112 for accessing the beverage, the spout 112 comprising of a neck 114 and a cap 116, an outer casing 118 surrounding the inner casing 110 and an opening 120 in the outer casing 118 for accessing the spout 112 of the inner casing 110. The inner casing 110 is preferably made of any material suitable for holding a beverage, which may include but is not limited to, plastic, aluminum or a mixture of various materials. The spout is made of materials which are generally used or known for making the spout of a beverage container. The cap 116 of the spout may be a screw cap, flip-top cap, push-pull cap, valve cap or other caps typically known in the art. The outer casing 118 material varies. For example, in a soccer ball themed version of the invention the outer casing is preferably made of a synthetic leather such as polyurethane or poly vinyl chloride, which is the same material use to make the covering of an actual soccer ball. While the outer casings 118 of preferred embodiments of the invention are preferably made of the material that the real versions are made from, other embodiments may be made from plastics or other materials commonly known for making beverage containers.

Figure 3A:
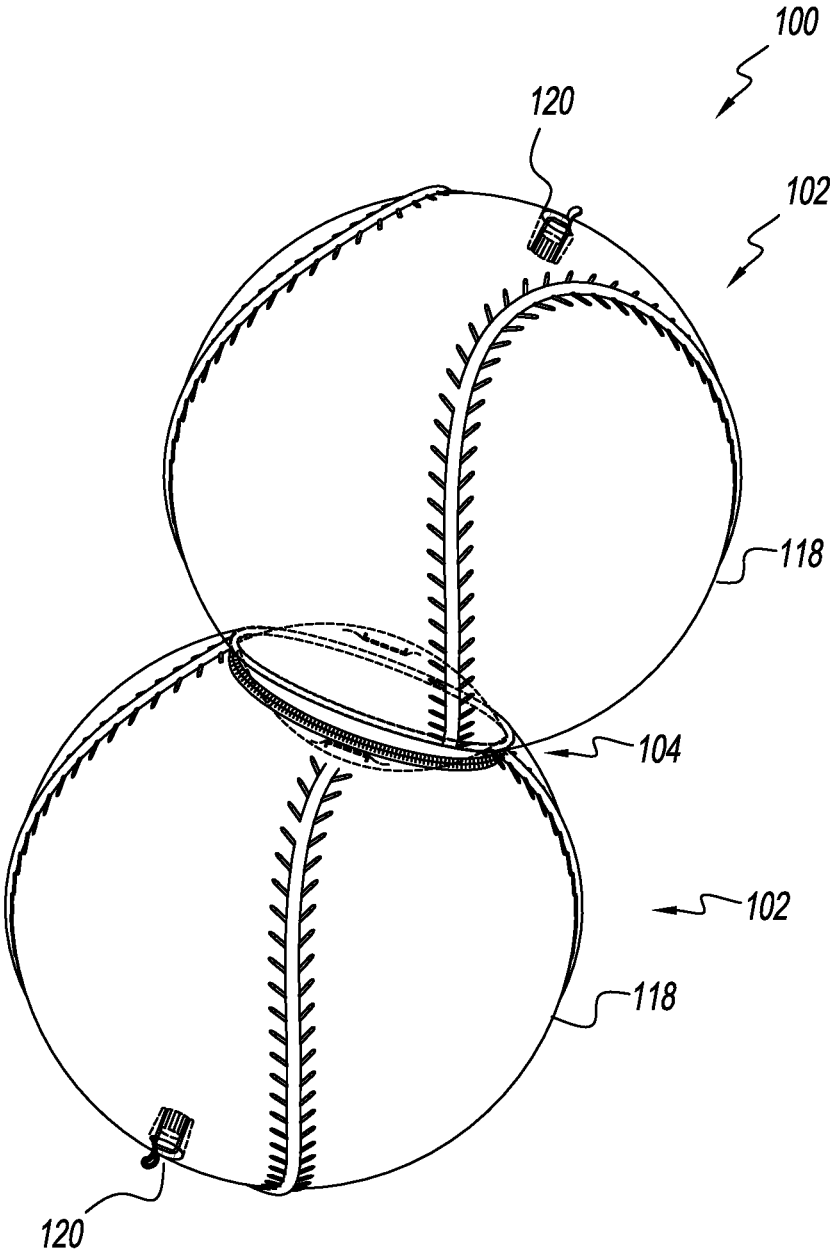
FIG. 3*a* is a perspective view of a beverage container according to an embodiment of the present invention.
Figure 3B:
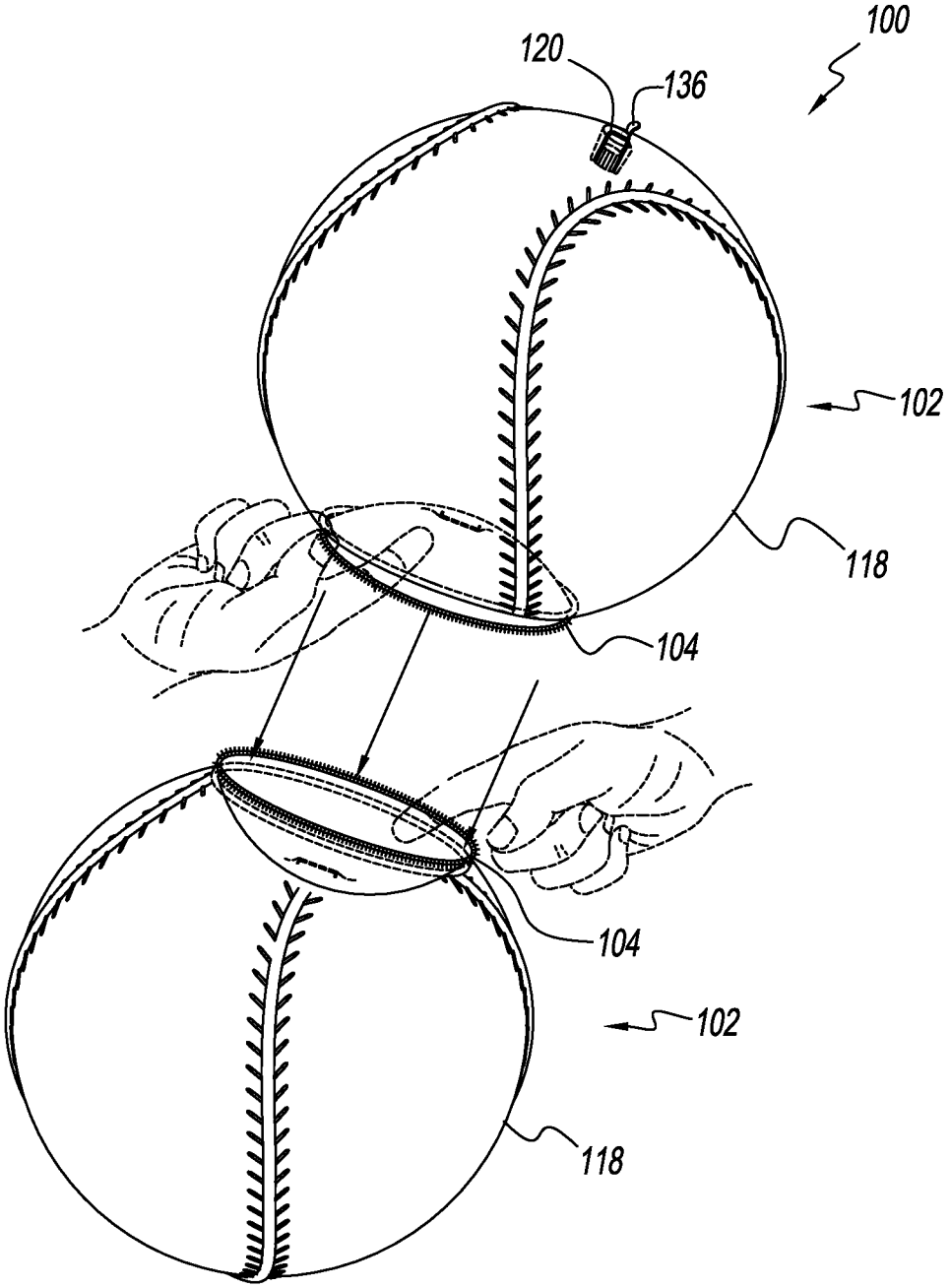
FIG. 3*b* is a perspective view of a beverage container according to an embodiment of the present invention.
Figure 4:
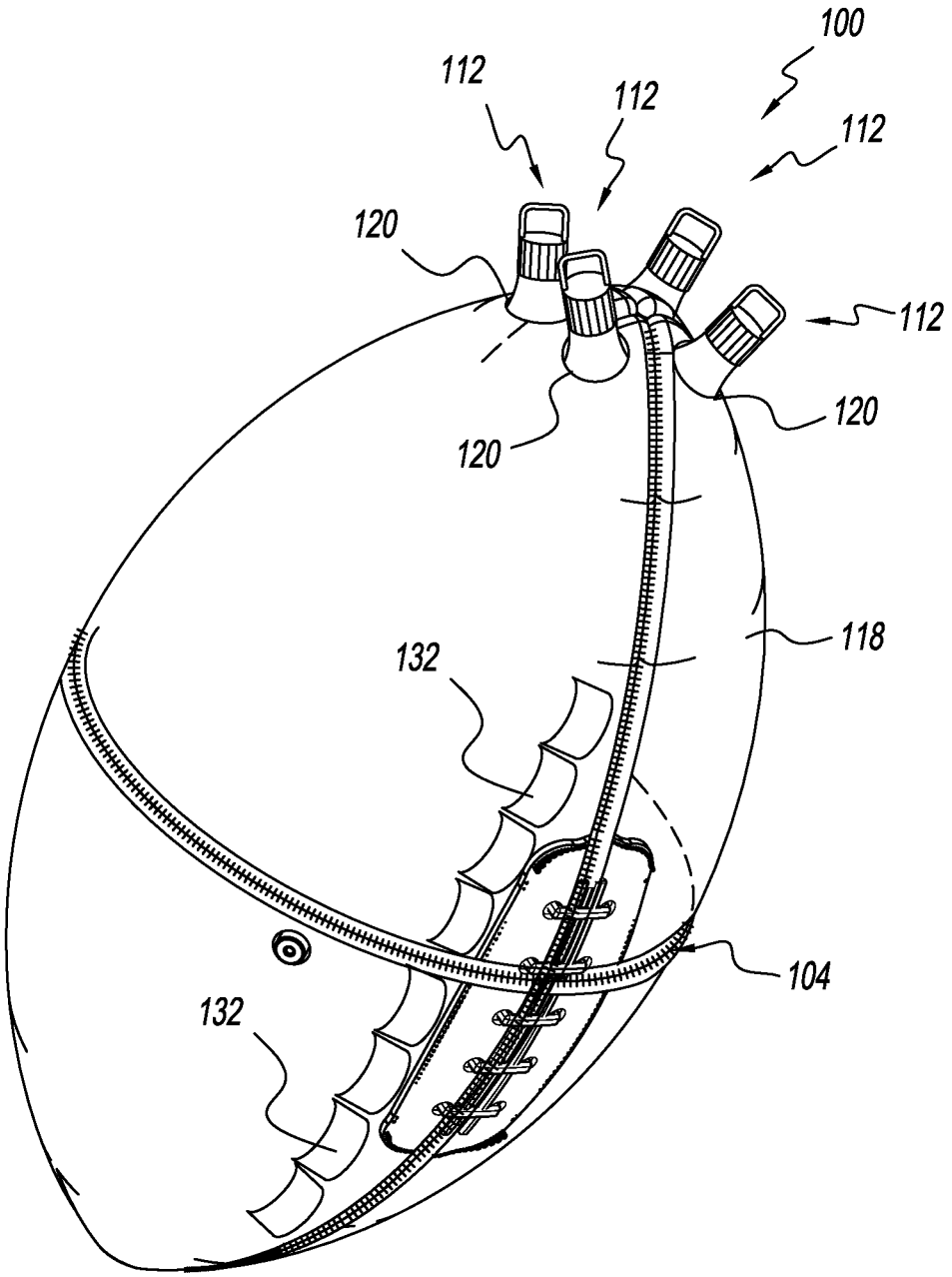
FIG. 4 is a perspective view of a beverage container according to an embodiment of the present invention.
Figure 5:
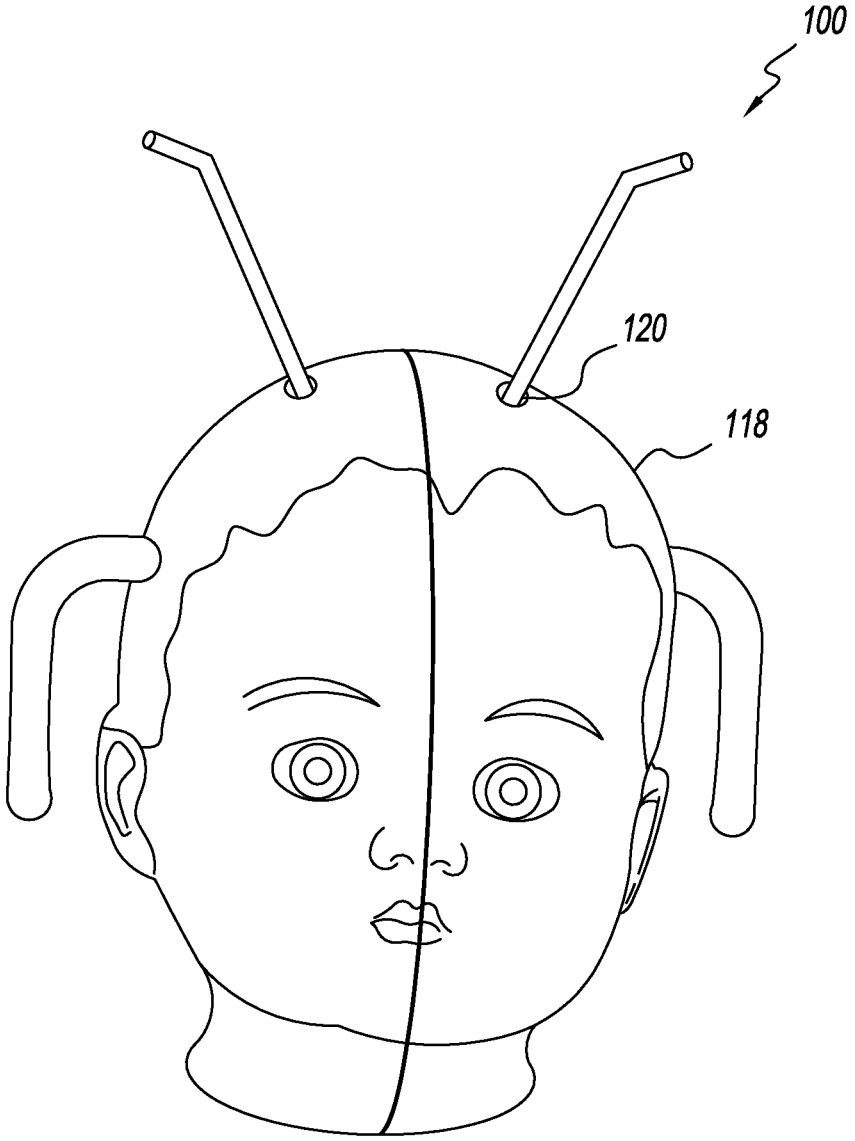
FIG. 5 is a perspective view of a beverage container according to an embodiment of the present invention.
Figure 6:
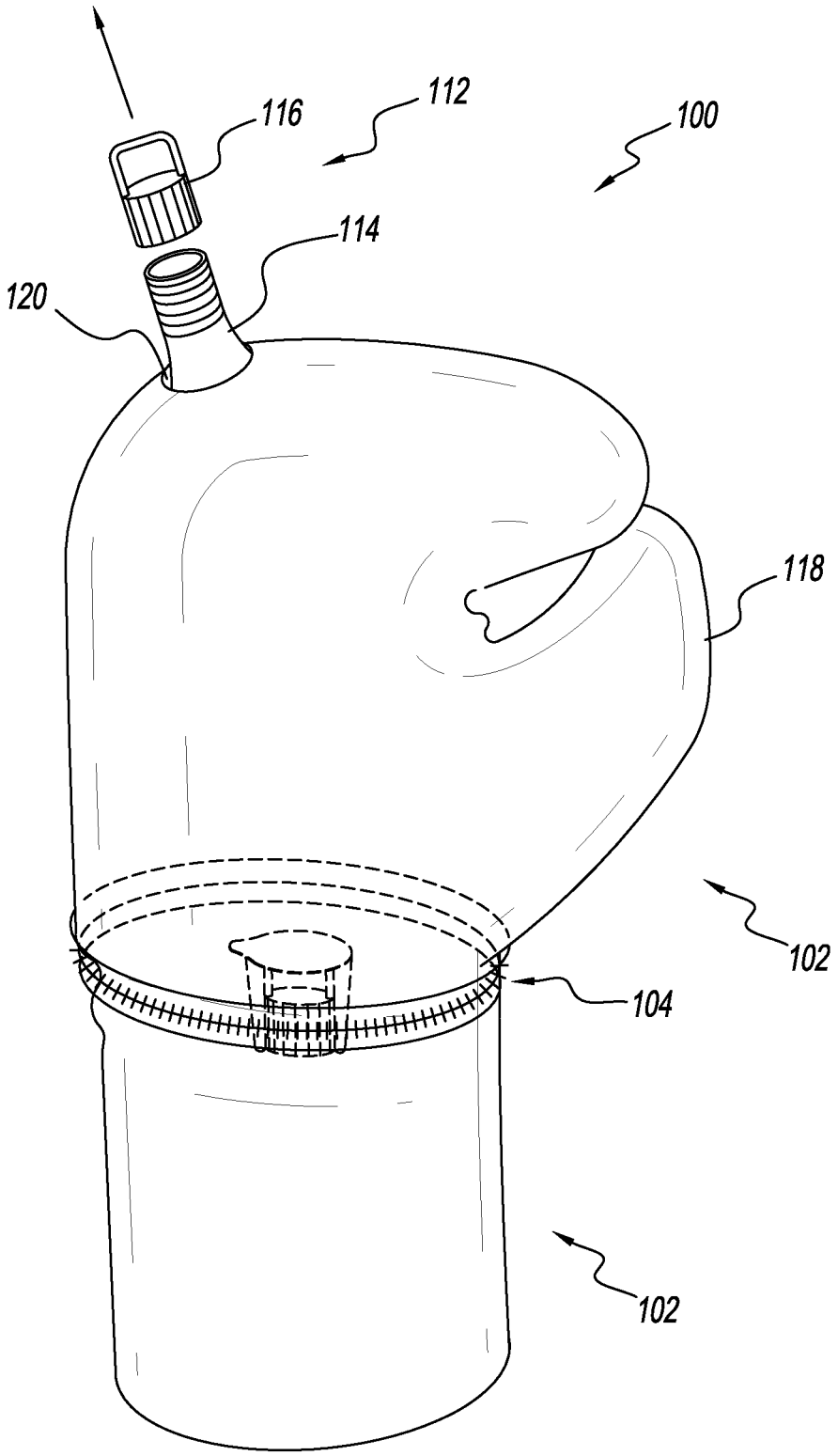
FIG. 6 is a perspective view of a beverage container according to an embodiment of the present invention.

The outer casing 118 may be customized to take the shape of a sports item or well-known television or movie character. For example FIGS. 3-6 show perspective views of various embodiments of the present invention. Specifically, FIGS. 3*a* and 3*b* show perspective views of an embodiment of the present invention where the outer casing 118 is baseball shaped. FIG. 4 shows a perspective view of an embodiment of the present invention where the outer casing 118 is football shaped. FIG. 5 shows a perspective view of an embodiment of the present invention where the outer casing 118 is doll head shaped. FIG. 6 shows a perspective view of an embodiment of the present invention where the outer casing 118 is boxing glove shaped. In one embodiment, the present invention also comprises of a grip 132 for holding the beverage container 100. The outer casing 118 may also contain marketing information, by way of example only, marketing information may include a company's branding, or a sports team's logo and/or colors.

In an embodiment of the present invention according to FIG. 3*a*, FIG. 3*b*, and FIG. 4, the beverage container 100 is divisible into at least two segments 102 to allow multiple users to be served simultaneously, wherein each segment 102 is removably attached by a connector 104, the connector 104 comprising of two or more corresponding parts. For example, FIG. 3 shows a double serve baseball shaped beverage container 100, and FIG. 4 shows a quadruple serve football shaped beverage container 100. The connector 104 may comprise of, but is not limited to, magnets, male and female connectors and fasteners, hook and eye fasteners, hook and loop fasteners, or similar male and female connectors generally known in the art. In this embodiment of the present each segment 102 comprises of an outer casing 118 surrounding an inner casing 110 and an opening 120 in the outer casing 118 for accessing the spout 112 of the inner casing 110, the spout 112 comprising of a neck 114 and a cap 116.

Figure 8A:
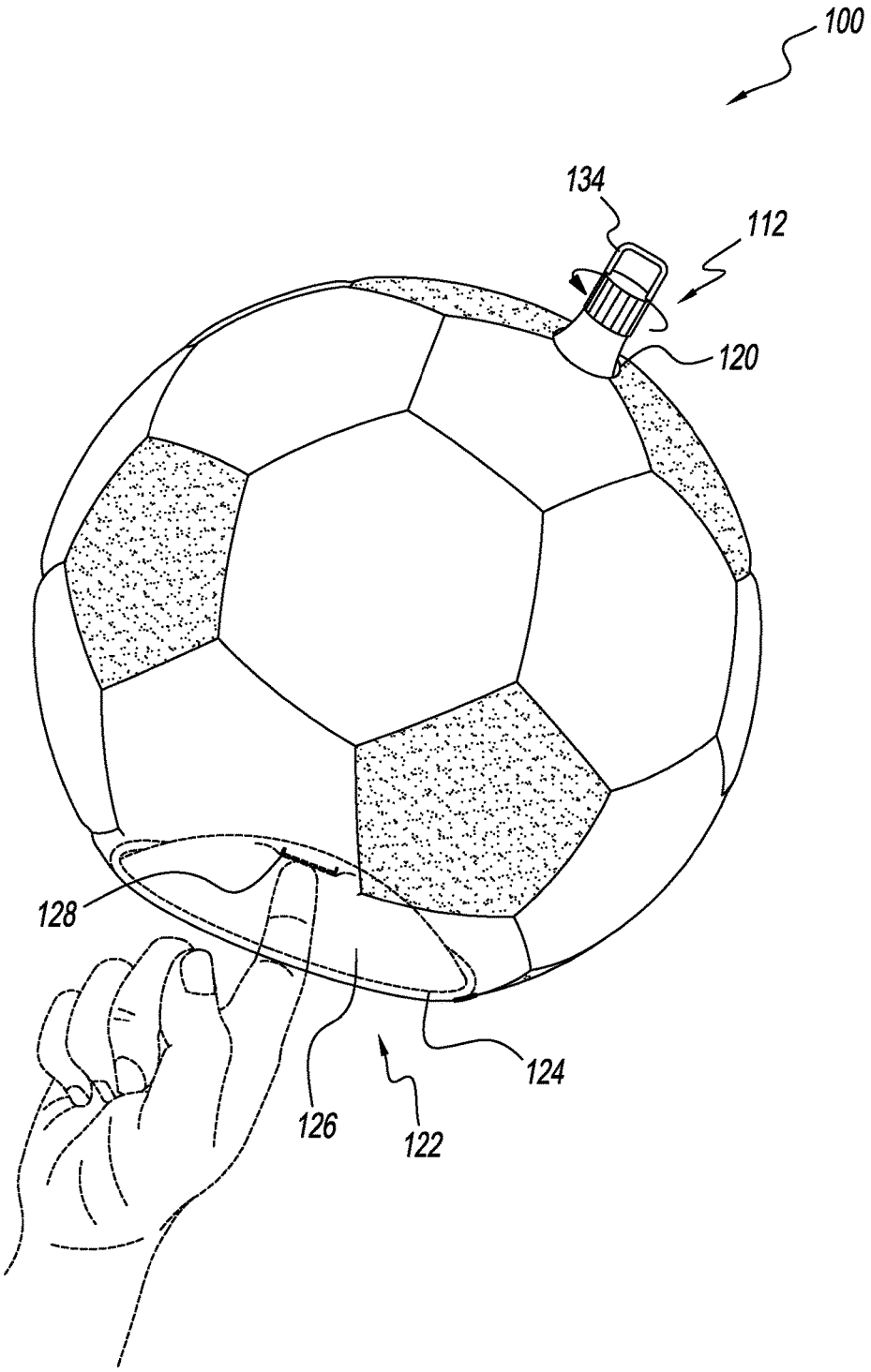
FIG. 8*a* is a perspective view of a placement surface of a beverage container according to an embodiment of the present invention.
Figure 8B:
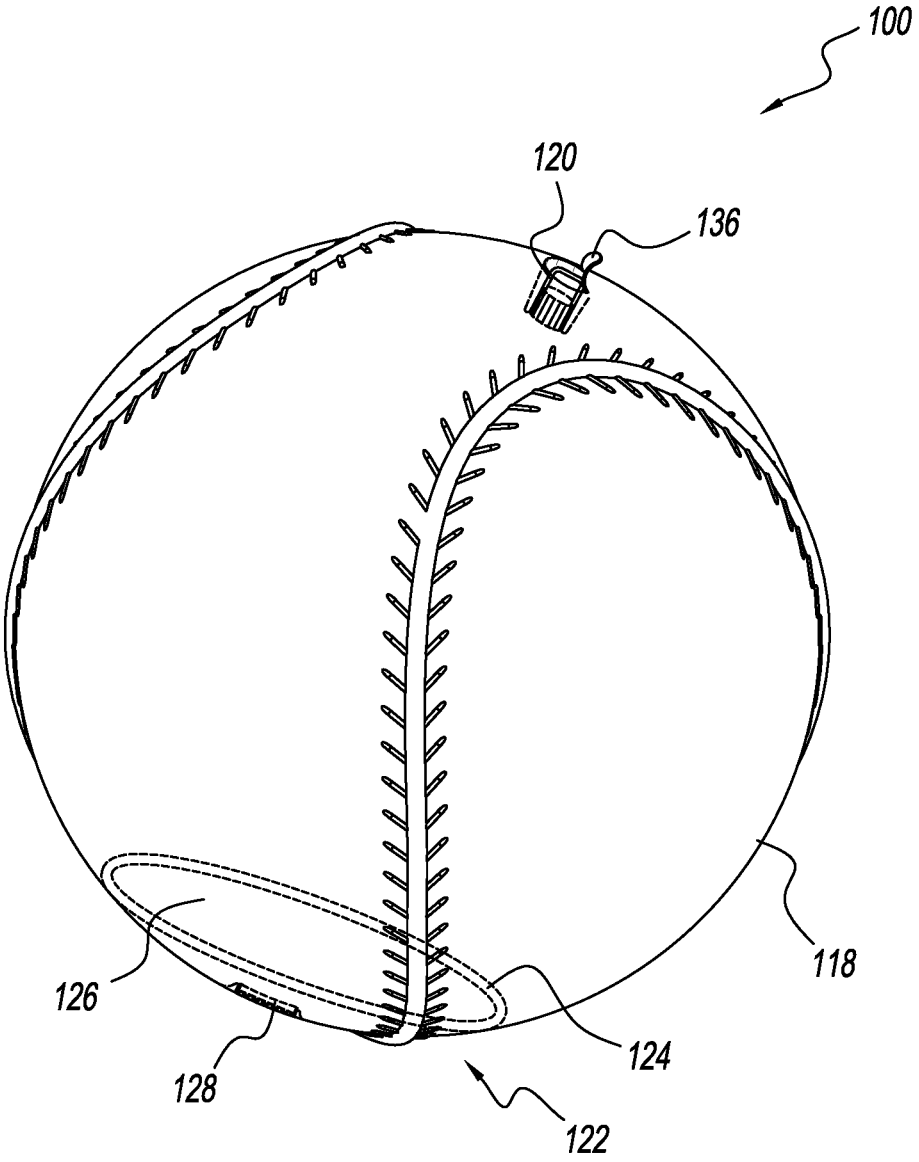
FIG. 8*b* is a perspective view of a placement surface of a beverage container according to an embodiment of the present invention.
Figure 9:
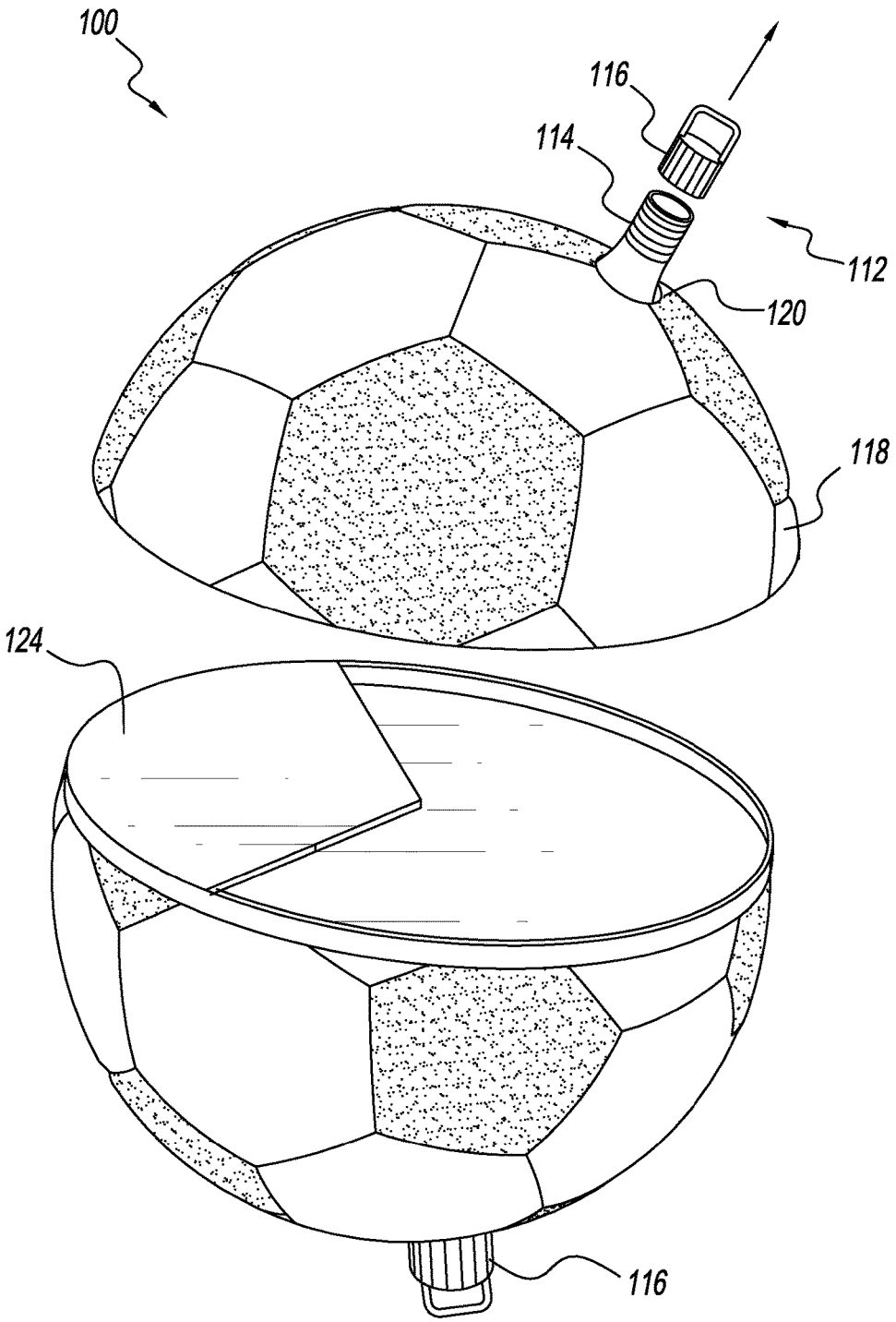
FIG. 9 is a perspective view of a beverage container according to an embodiment of the present invention.

In embodiments of the present invention the outer casing 118 of the beverage container 100 further comprises of at least one placement surface 122 for allowing the beverage container 100 to sit stably on a flat surface (See FIGS. 1-6). As shown in FIG. 8*a* and FIG. 8*b*, the at least one placement surface 122 comprising of a rigid ring 124 surrounding a flexible material 126. The flexible material 126 further comprises of a pull 128 in the center of the flexible material 126 for manipulating the shape of the flexible material 126. The rigid ring 124 may be hollow or solid and its diameter varies based on the shape of the outer casing 118 of the beverage container 100. The rigid ring 124 is of a width appropriate to cause the beverage container 100 to sit stably when placed on a flat surface. The rigid ring 124 is secured to the outer casing and is preferably made of a hard plastic or rubber, however it can be made of any rigid material suitable for providing a separation between the outer casing 118 and the flexible material 126. The flexible material 126 is preferably hard plastic or a similar material which has the ability to move under pressure while maintaining the position in which it is placed. The flexible material 126 may be the same material as that of the outer casing 118, where such material is sufficiently flexible. A user of the beverage container 100 who wishes to place the beverage container 100 on a flat surface, pushes the flexible material 126 inwards towards the center of the beverage container 100 causing the flexible material 126 to form a concave shape, thereby a horizontal plane (the placement surface 122) for sitting the beverage container 100 stably on a flat surface. The pull 130 at the center of the flexible material 126 is used for pulling the flexible material 126 back into its original shape from a concave position.

Figure 7:
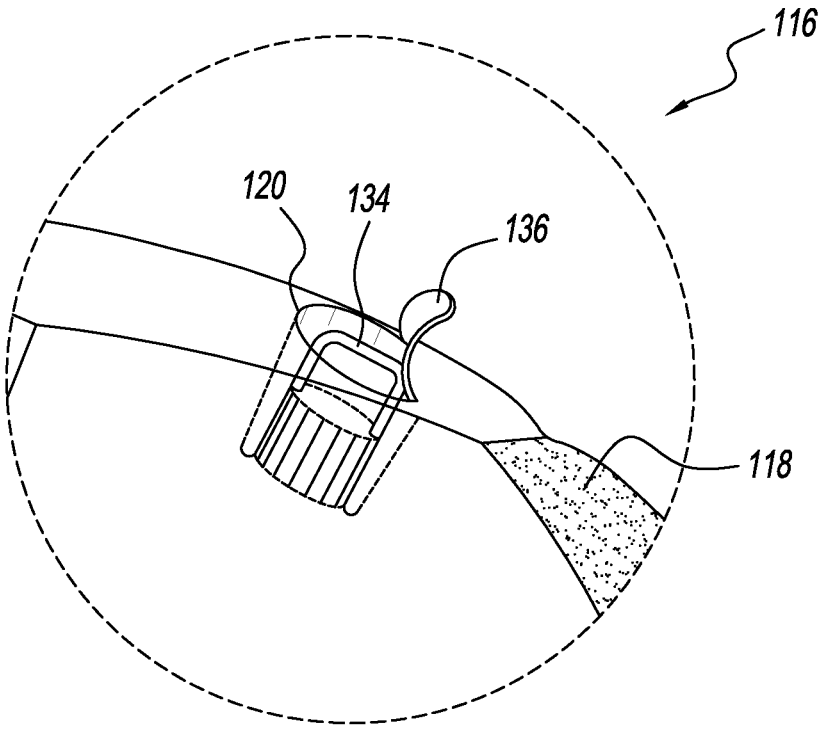
FIG. 7 is a perspective view of a spout of a beverage container according to an embodiment of the present invention.

In an embodiment of the present invention as shown in FIG. 7, the cap 116 further comprises of a lift 134 for pulling the spout 112 through the opening 120 of the outer casing 118. The outer casing 118 further comprises of a flap 136 covering the opening 120 of the outer casing for hiding the spout 112 when not in use.

What is claimed is:

1. A beverage container, comprising:

an inner casing for holding a beverage, the inner casing comprising of a spout for accessing the beverage, the spout comprising of a neck and a cap;

an outer casing surrounding the inner casing wherein the outer casing comprises at least one placement surface for allowing the beverage container to sit stably on a flat surface, the at least one placement surface comprising of a rigid ring surrounding a flexible material wherein the flexible material can be manipulated using pressure into a concave shape creating a horizontal plane for allowing the beverage container to sit stably on a flat surface; and an opening in the outer casing for accessing the spout of the inner casing.

2. The beverage container of claim 1, wherein the outer casing further comprises of a grip for allowing a user to hold the beverage container securely.

3. The beverage container of claim 1, wherein the shape of the outer casing is sports-themed.

4. The beverage container of claim 3, wherein the outer casing further comprises of marketing information.

5. The beverage container of claim 1, wherein the outer casing further comprises of marketing information.

6. The beverage container of claim 1, further comprising of a pull in the center of the flexible material for manipulating the shape of the flexible material.

7. A beverage container, comprising of:

at least two segments, the at least two segments each comprising of an outer casing wherein the outer casing of each of the at least two segments are removably attached by a connector, the connector comprising of two or more corresponding parts;

wherein each of the at least two segments comprises of an inner casing for holding a beverage, the inner casing of each of the at least two segments comprising of a spout for accessing the beverage, the spout comprising of a neck and a cap;

the outer casing of each of the at least two segments comprising of an opening for accessing the spout of the inner casing of each of the at least two segments;

and wherein the outer casing of each of the at least two segments further comprise of at least one placement surface allowing the beverage container to sit stably on a flat surface, the at least one placement surface comprises of a rigid ring surrounding a flexible material wherein the flexible material can be manipulated using pressure into a concave shape creating a horizontal plane for allowing the beverage container to sit stably on a flat surface.

8. The beverage container of claim 7, wherein each segment of the outer casing further comprises of a grip.

9. The beverage container of claim 8, wherein the shape of the outer casing is sports-themed.

10. The beverage container of claim 9, wherein the outer casing further comprises of marketing information.

11. The beverage container of claim 7, wherein the shape of the outer casing is sports-themed.

12. The beverage container of claim 11, wherein the outer casing further comprises of marketing information.

13. The beverage container of claim 7, wherein the flexible material further comprises of a pull in the center of the flexible material for manipulating the shape of the flexible material.

* * * * *